US007424238B2

(12) United States Patent
Yamauchi et al.

(10) Patent No.: US 7,424,238 B2
(45) Date of Patent: Sep. 9, 2008

(54) IMAGE FORMING APPARATUS WITH CONFIRMATION OUTPUT FUNCTION AND CONTROLLING METHOD THEREOF

(75) Inventors: Kazumichi Yamauchi, Hachioji (JP); Satoshi Sakata, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 167 days.

(21) Appl. No.: 11/397,760

(22) Filed: Apr. 5, 2006

(65) Prior Publication Data

US 2007/0009279 A1 Jan. 11, 2007

(30) Foreign Application Priority Data

Jul. 8, 2005 (JP) ..... 2005-199847

(51) Int. Cl.
*G03G 15/00* (2006.01)

(52) U.S. Cl. ..... 399/82; 399/81; 399/86; 399/370; 399/376

(58) Field of Classification Search ..... 399/45, 399/81, 82, 85, 86, 370, 376, 389
See application file for complete search history.

(56) References Cited

U.S. PATENT DOCUMENTS 6,516,178 B2 * 2/2003 Fukushima ..... 399/376

* cited by examiner

*Primary Examiner*—Hoang Ngo
(74) *Attorney, Agent, or Firm*—Finnegan, Henderson, Farabow, Garrett & Dunner, L.L.P.

(57) ABSTRACT

An image forming apparatus has a job information acquiring unit for acquiring job information which includes job-related sheet size information, a confirmation-output size determining unit for determining the size of a sheet for confirmation output according to the job information, a job information position designating unit for specifying a portion of the job image information to be printed out on a confirmation-output sheet of a size which is determined by the confirmation-output size determining unit, an editing unit for editing the portion of job image information specified by the job information position designating unit as confirmation-output image information on the confirmation-output sheet of a size determined by the confirmation-output size determining unit, and an image forming unit for carrying out image forming of confirmation-output image information edited by the editing unit on the confirmation-output sheet.

20 Claims, 9 Drawing Sheets

FIG. 5
| JOB SHEET SIZE | CONFIRMATION COPY SHEET SIZE |
|---|---|
| A3 WIDE | A3 |
| A3 | B4 |
| B4 WIDE | B4 |
| B4 | A4 |
| A4 WIDE | A4 |
| A4 | B5 |
| B5 WIDE | B5 |
| B5 | A5 |
FIG. 6
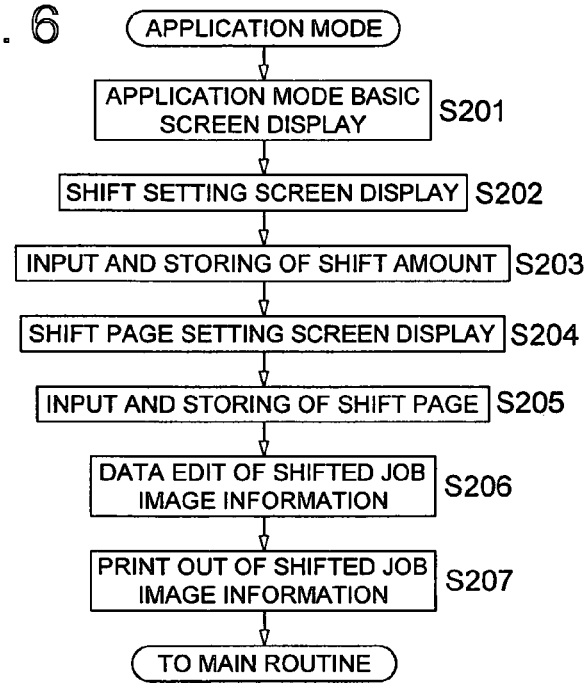
FIG. 7
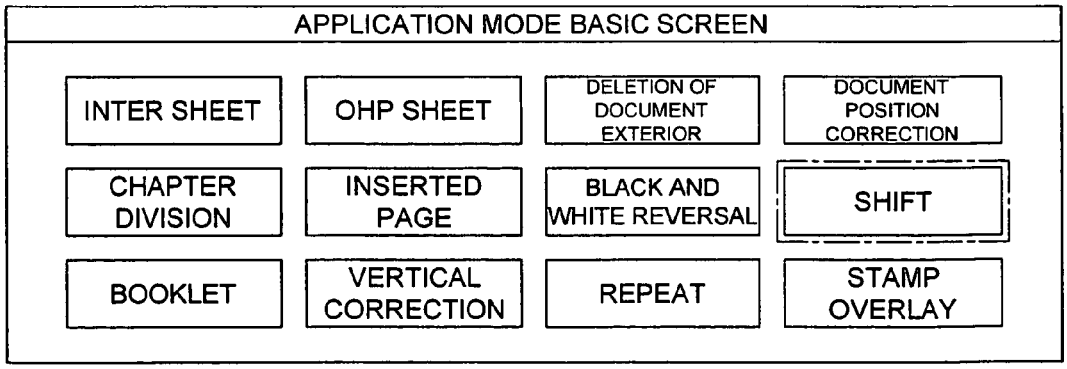

IMAGE FORMING APPARATUS WITH CONFIRMATION OUTPUT FUNCTION AND CONTROLLING METHOD THEREOF

BACKGROUND OF THE INVENTION

This invention relates to an image forming apparatus which enables confirmation outputs and a method for controlling the image forming apparatus.

Conventional image forming apparatuses for printing industries and so on have been required to print out a great number of copies of high print-out image qualities. If any print-out flaw is found, correction and re-printing are required after a great number of printouts are made. This will waste a lot of toner and paper. To solve such a problem, there have been some kinds of image forming apparatuses that can test-print the job images and the like (for confirmation output). (For example, see Patent Documents 1, 2, and 3.)

However, although the image forming apparatus disclosed by Patent Document 1 enables test-prints on ordinary paper sheets for confirmation output even when a special kind of paper is specified as job information, it is impossible to check the trimmed printout image after a trimming process by the confirmation output.

Further, the image forming apparatus disclosed by Patent Document 2 prints out images near the stapling margin of sheets when a stapling process is designated. This enables reduction of the quantity of used toner and confirmation of print-out status of images, but it is impossible to check the trimmed printout image after a trimming process by the confirmation output.

The image forming apparatus disclosed by Patent Document 3 can feed a sheet larger than what is required for confirmation output and print out an image frame of the confirmation-output size even when a sheet of the required size for confirmation output is not set. This enables confirmation of the test-print size but it is impossible to check the trimmed printout image after a trimming process by the confirmation output.

[Patent Document 1] Unexamined Japanese Patent Application Publication H08-101542

[Patent Document 2] Unexamined Japanese Patent Application Publication H11-38836

[Patent Document 3] Unexamined Japanese Patent Application Publication 2004-138673

SUMMARY

A feature of this invention may provide an image forming apparatus which can carry out test-printing to confirm the trimmed sheet and the condition of images printed on the sheet before starting image formation relating to a job.

The invention can be accomplished by the followings.

(1) An image-forming apparatus comprising a job information acquiring unit for acquiring job information which includes sheet size information, relating to a job, a job image information acquiring unit for acquiring job image information relating to a job, a confirmation-output size determining unit for determining a size of a sheet for confirmation output according to the job information, a job information position designating unit for designating an output portion of the job image information to be printed out on a confirmation-output sheet whose size is determined by the confirmation-output size determining unit, an editing unit for editing the job image information as confirmation-output image information based on a designation made by the job information position designating unit and a confirmation-output size determined by the confirmation-output size determining unit, and an image forming unit for forming an image of confirmation-output image information edited by the editing unit on the confirmation-output sheet.

(2) An image forming apparatus comprising a job information acquiring unit for acquiring job information which includes sheet size information, relating to a job, a job image, information acquiring unit for acquiring job image information relating to a job and including a register mark, a confirmation-output size determining unit for determining a size of a sheet for confirmation output according to the job information, an editing unit for editing the job image information as confirmation-output image information based on the register mark and the confirmation-output size determined by the confirmation-output size determining unit, and an image forming-unit for forming an image of the confirmation-output image information edited by the editing unit on a confirmation-output sheet.

(3) A controlling method of an image forming apparatus, the controlling method comprising steps of acquiring job image information relating to a job, acquiring job information relating to a job, inputting information of a confirmation-output sheet whose size is smaller than a sheet size of sheet size information in the job information, designating an output portion of the job image information to be printed out on the confirmation-output sheet, editing designated information in the job image information as confirmation-output information, and forming an image of the edited confirmation-output information on the confirmation-output sheet.

BRIEF DESCRIPTION OF THE DRAWINGS

FIG. 5 shows an example of sheet size correspondence table stored in ROM.

FIG. 6 shows a flow diagram of the application copy mode.

FIG. 7 shows an example of basic screen for designating application copy modes.

DETAILED DESCRIPTION OF THE PREFERRED EMBODIMENT

Embodiments of this invention will be explained below. It is to be expressly understood, however, that the embodiments are not intended as the limits of a definition of the technical ranges and terms given in what is claimed.

In the case of handling a lot of print-outs in a printing business or other business field, they generally print out images together with register marks (cross marks) on each sheet which is larger than the trimmed final print-out page, stack and trim the printed sheets according to the register marks, and bind them into booklets or the same for example.

Print-outs may be wasted if print errors are found on them. The present inventors thought that it was possible to obtain the image of the final appearance in advance and reduce printing errors by test-printing images on a sheet of the same size as the final print-out for confirmation output before printing.

More specifically, a confirmation output is carried out on a sheet of the same (or similar) size as the final sheet after trimming. Practically, images are test-printed on a sheet of a product size (A4 for example) which is smaller than an untrimmed sheet (A4 wide for example) which includes register marks for the job. With this method, the print-out image condition after the trimming process can be confirmed.

"Confirmation output" means test-printing of images in order to confirm image print-out status and positions before starting image formation of a job. "Confirmation-output information" indicates information related to confirmation output (for example, page information of a job which performs confirmation output).

"Job" indicates a bundle of document sheets or a set of image information (for example, image information, and register mark information which indicates cut-out positions) as a unit (hereinafter, job images are also called job image information). "Job information" indicates a print-out condition related to a set of image information (for example, job's sheet size information, number of copies).

Next will be explained the configuration and operation of the image forming apparatus of the present embodiment.

Figure 1:
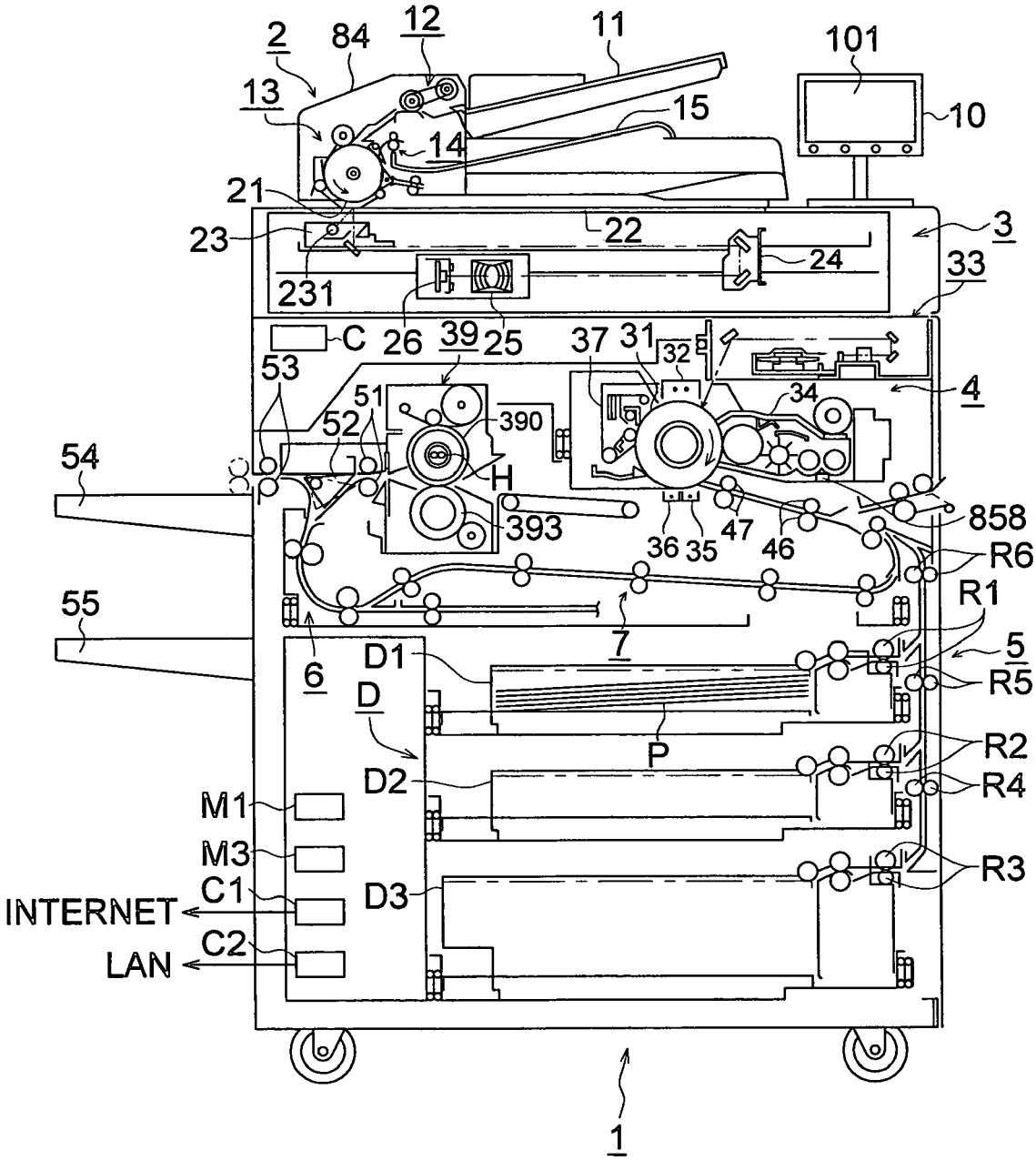
FIG. 1 shows a sectional view of an example of an image forming apparatus.

FIG. 1 shows a sectional view of an example of image forming apparatus.

The image forming apparatus 1 will be explained below. Automatic document feeder 2 picks up each sheet from a bundle of document sheets or job document sheets and delivers it to an image reading position and discharges it. Image reading unit 3 reads each document sheet at the image reading position. Image forming unit 4 forms a toner image according to the read image data. Large-capacity automatic sheet feeding unit D picks up each sheet of the designated size from its sheet tray and feeds it to sheet feeder 5. Sheet feeder 5 feeds each sheet from automatic sheet feeding unit D to the toner image transferring position. Large-capacity automatic sheet feeding unit D and sheet feeder 5 constitute a sheet feeding unit. Reversing and re-feeding unit 6 reverses a sheet which retains an image on it and feeds it back to the image transferring position. Reverse-transportation unit 7 reverses a sheet. Operation panel 10 is equipped with a touch panel, operation switches, and the like to display apparatus status and to enable the operator to enter job information, information related to confirmation output, and register mark information. Internet communication unit C1 enables the image forming apparatus to communicate with outside servers via the Internet. LAN communication unit C2 enables communication with servers and other image forming apparatuses via a local area network (hereinafter abbreviated as LAN). Random access memory (hereinafter abbreviated as RAM) M1 is a re-writable storage unit which is, for example, backed up by a battery. Read-only memory (hereinafter abbreviated as ROM) M2 is a non-volatile storage unit which stores an image-formation control program, a communication control program, and other programs in advance. Control unit C controls the above components.

The operation of image forming apparatus 1 is as follows. When the operator enters job information, other information, and a command to start image formation from operation panel 10, image forming apparatus 1 starts. With this, automatic document feeder 2 on image forming apparatus 1 takes sheets (not shown in the figure) one by one from plural documents on document tray 11 while separating sheets by document separator 12 and sends each sheet to the image reading position by document delivering unit 13.

The document reading position is provided below document delivering unit 13. Document images or job image information are read through slit 21 of image reading unit 3.

The read document sheet is sent to document discharging tray 15 by document discharging unit 14.

The image forming apparatus is also designed to directly copy a document sheet which is placed on platen glass 22.

Image reading unit 3 is equipped with lamp 231 for illuminating a document sheet through slit 21, first mirror unit 23 for reflecting light which comes from the document sheet, second mirror unit 24, imaging lens 25 for forming image on an image pickup element, and linear CCD 26 for converting the light image formed by imaging lens 25 into electricity.

An analog signal, which is read and photo-electrically converted by CCD 26, is converted into a digital signal after the analog processing. The digital signal is further processed by an image processor (not shown in the figure) for shading correction, filtration, $\gamma$ correction, or the like, and temporarily stored in RAM M1.

Internet communication unit C1 can be used to get job image information and job information from external server or personal computer (hereinafter abbreviated as PC) via the Internet. Further, LAN communication unit C2 can also be used to get job image information and job information from other image forming apparatuses, servers or the like via LAN.

These communication units enable the image forming apparatus to get job image information and job information from PCs, servers, scanners, and the like at remote locations or on the other floors.

Image forming unit 4 works to form-images using an electro-photographical process and is equipped with photosensitive drum 31 image retainer whose surface is coated with a photoconductive photosensitive layer as an image carrier, charger 32 to apply an even electric charge to the surface of photosensitive drum 31, laser writing system 33 as an exposing unit which is driven to expose and form an electrostatic latent image on the surface of photosensitive drum 31 according to the processed image data, developing unit 34 which develops the electrostatic latent image on the surface of photosensitive drum 31 into a toner image, transferring electrode 35 to transfer the visualized toner image onto a sheet, static eliminator 36 which applies A.C. corona discharge to the back of the transferred sheet to make the sheet easily separated from the surface of photosensitive drum 31, and cleaning unit 37 to clean photosensitive drum 31 after the transferring process is complete.

Fixing unit 39 is equipped with built-in heater H, heating roller 390 which revolves around heater H, and press roller 393 which revolves while being pressed against heating roller 390. In the downstream side of fixing unit 39, are provided fixing/discharge roller 51 and switching unit 52 which are constituents of the revering and re-feeding unit 6, and discharge rollers 53 to discharge each sheet to the outside of the image forming apparatus.

Image forming unit 4 and fixing unit 39 form an image on a sheet by causing charger 32 to charge photosensitive drum 31 which is driven to rotate in the arrow direction by a driving unit (not shown in the figure), causing laser writing system 33 to form an electrostatic latent image on the surface of photosensitive drum 31 by dot-exposure according to job image information, causing developing unit 34 to make the latent image visible as a toner image, causing transferring electrode 35 to transfer the toner image onto sheet P which is delivered by rotation of registration roller 46 which is a second sheet feeder, and causing fixing unit 39 to fix the toner image to the sheet.

Large-capacity automatic sheet feeding unit D is equipped with sheet supply trays D1 to D3 which have large-capacity, picks up and delivers sheet P from a sheet supply tray of a size selected according to job information by delivery roller pairs (hereinafter abbreviated by delivery rollers) R1, R2, R3, R4, and R5 as a delivery unit.

Sheet feeder 5 works to deliver sheet P from large-capacity automatic sheet feeding unit D to image forming unit 4 as a delivery unit. Sheet feeder 5 is equipped with delivery roller pair R6 (hereinafter abbreviated by delivery rollers), registration rollers 46, and pre-transfer rollers 47 to deliver sheet P from large-capacity automatic sheet feeding unit D to image forming unit 4.

Further, it is possible to connect a publicly-known sheet feeder (not shown in the figure) capable of containing a large amount of sheets to the upstream side of image forming apparatus 1 and cause apparatus 1 to communicate with the feeder to feed sheets of a selected size into apparatus 1.

Reversing and re-feeding unit 6 reveres transferred and fixed sheet P for discharge or re-feeds the reversed sheet to image forming unit 4 according to the double face print mode. Normally, sheet P is delivered over the upper surface of the switching unit 52 by the fixing and delivering rollers 51 and finally to large-capacity sheet stacking tray 54 by discharge rollers 53 of the discharge unit.

It is possible to make sheet stacking trays 54 and 55 movable vertically by a moving unit (not shown in the figure) so as to receive sheets on sheet stacking tray 54 normally and to receive confirmation-output sheets for example on sheet stacking tray 55 after moving sheet stacking trays 54 and 55.

Further, it is possible to connect a publicly-known large capacity sheet stacker (not shown in the figure) to the downstream side of image forming apparatus 1 and cause apparatus 1 to communicate with image forming apparatus 1 to discharge sheets into trays of selected sheet sizes.

Below will be explained the configuration of an image forming apparatus which is a first embodiment of this invention and a method of controlling-automatic input of the size of a confirmation-output sheet in reference with FIGS. 1 to 7.

Figure 2:
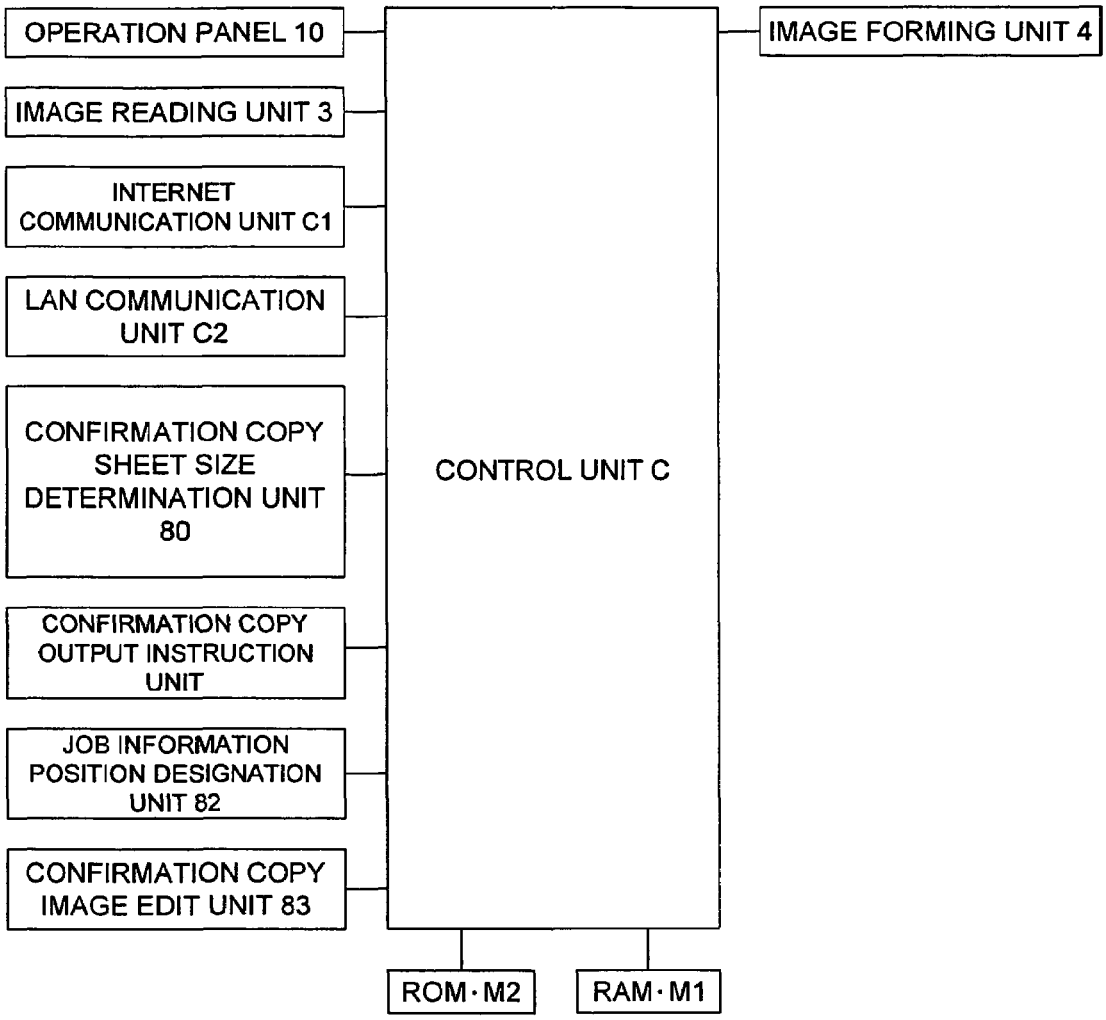
FIG. 2 shows a block diagram of a first embodiment of control of an image forming apparatus.

FIG. 2 shows a block diagram of a first embodiment of control of the image forming apparatus.

Image forming apparatus 1 is equipped with the followings.

Internet communication unit C1, local area network (hereinafter abbreviated as LAN) communication unit C2 and operation panel 10, are job information acquiring units to acquire job information containing job-related sheet size information. Internet communication unit C1, LAN communication unit C2 and image reading unit 3, are job image acquiring units to acquire job image information containing job-related image information. Confirmation-output size determination unit 80 (confirmation copy sheet size determination unit), determines the size of a sheet on which a test printing is made according to the acquired job information. And job information position designation unit 82 designates a portion of job image information to be test-printed on a confirmation-output sheet of a size determined by the confirmation-output size determination unit 80 among job image information which is acquired from Internet communication unit C1, LAN communication unit C2, or image reading unit 3. Specifically, this unit 82 specifies an image area to be left after trimming. To specify the area, for example, the reference position (basis) of area for confirmation output is determined by designating a position from among any of four corners, any of centers of sides, the center or an arbitrary positions in job image information area (see the explanatory diagram of job information position designation in FIG. 13), Editing unit 83 (confirmation copy image edit unit) edits job image information as image information for confirmation output, which was acquired by the job image acquiring unit so as to test-print an area of the job image information designated by the job information position designation unit 82 onto a confirmation-output sheet of a size determined by the confirmation-output size determination unit 80.

Figure 13:
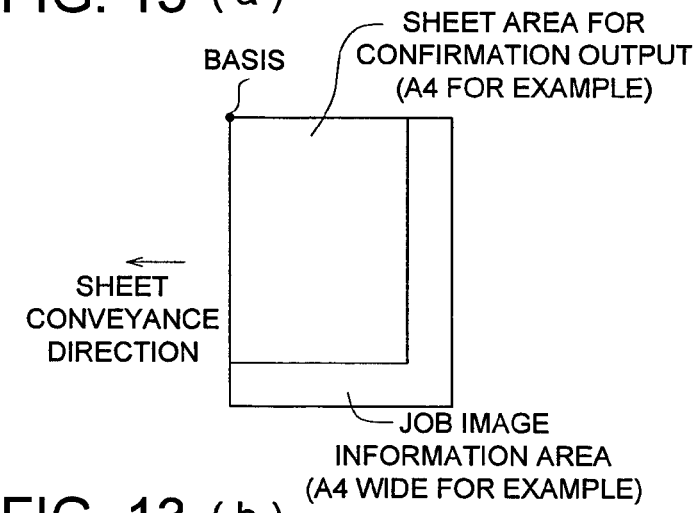
FIG. 13 shows explanatory drawings to designate job-information positions.
Figure 13:
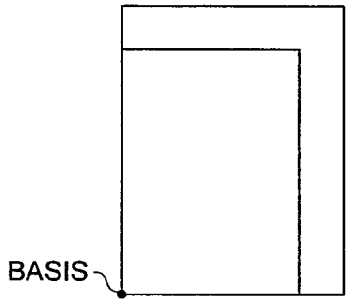
Figure 13:
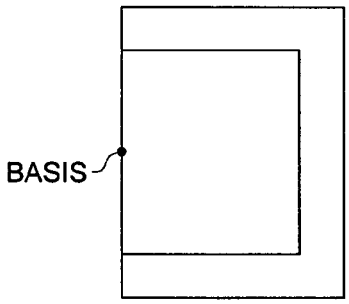
Figure 13:
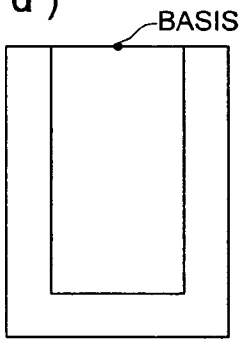
Figure 13:
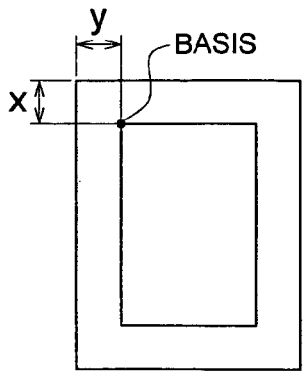
Figure 13:
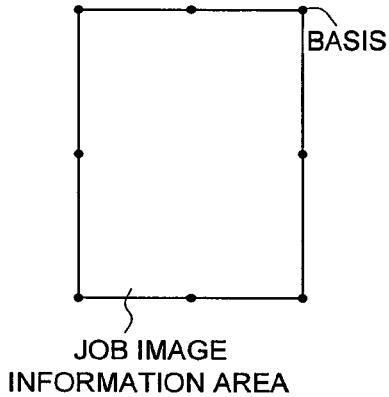

Image forming unit 4 prints out confirmation-output image information edited by the editing unit 83 on a confirmation-output sheet and is equipped with non-volatile ROM M2 which stores an image-formation control program, a communication control program and the like in advance, and battery-backed-up RAM M1 which reads and writes job image information, job information, confirmation-output image information, and other data, wherein the ROM and the RAM are connected to and controlled by control unit C FIG. 13(*a*) shows that the reference position (basis) of the confirmation-output area in the job image information is placed on the upper end of the left long side of the job image information area. Similarly, FIG. 13(*b*) shows that the reference position is placed on the lower end of the left long side of the job image information area. FIG. 13(*c*) shows that the reference position is placed on the center of the left long side of the job image information area. FIG. 13(*d*) shows that the reference position is placed on the center of the upper short side of the job image information area. FIG. 13(*e*) shows that the reference position is placed on any position (x/y) in the job image information area. FIG. 13(*f*) shows reference positions which can be designated in the job image information area (not including arbitrary designated positions). In other words, nine basis points of FIG. 13(*f*) and arbitrary points of FIG. 13(*e*) can be designated.

Image forming apparatus 1 performs controlling related to operations which are described in reference to FIG. 1.

Figure 3:
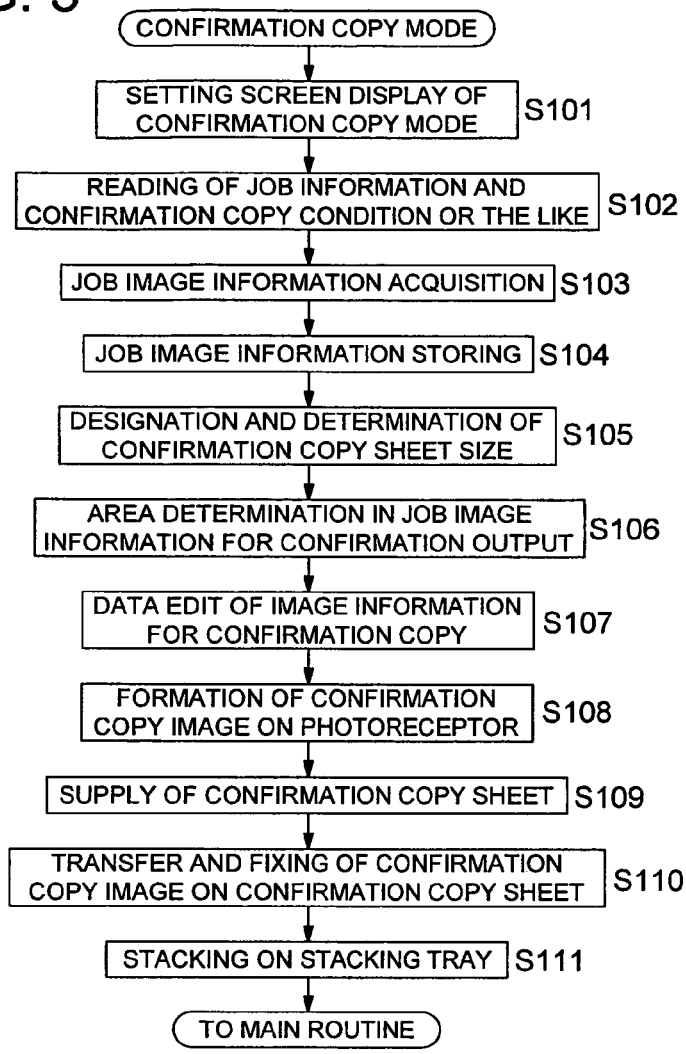
FIG. 3 shows a flow diagram of a first embodiment of control of an image forming apparatus.

FIG. 3 shows a flow diagram of a first embodiment of control of the image forming apparatus.

Figure 4:
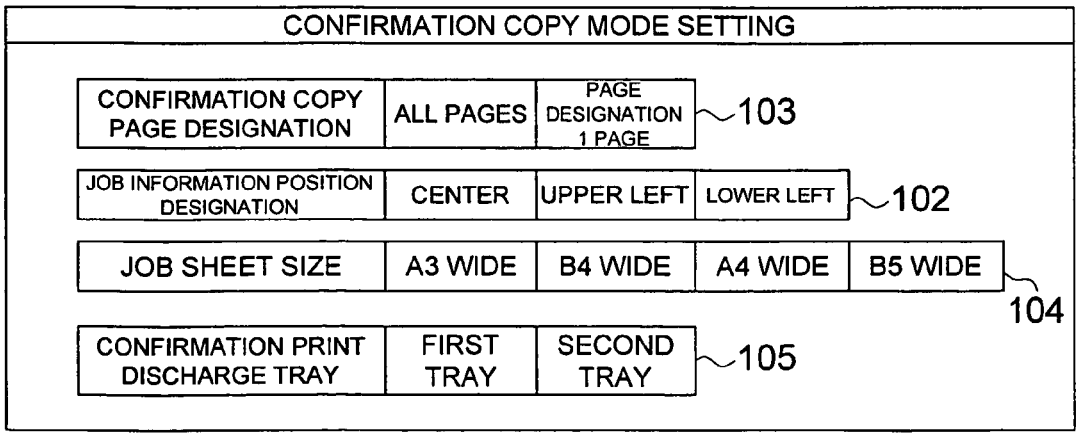
FIG. 4 shows an example of a confirmation-output mode screen for setting confirmation-output conditions.

FIG. 4 shows an example of confirmation-output mode setting screen for setting confirmation-output conditions.

A control flow of the image forming apparatus will be explained below referring to FIG. 2 to 4.

When receiving a starting command of confirmation-output mode from operation panel 10, control unit C starts the confirmation-output mode, reads information of confirmation-output mode setting screen previously stored in ROM M2, and displays a confirmation-output mode setting screen shown in FIG. 4 on a display unit 101 (hereinafter simply called touch panel 101) such as a touch panel on operation panel 10 (Step S101).

Control unit C reads confirmation-output page designation information, position designation information, each information of job sheet size information (for example, page 1, left center, A4 wide) selected and designated with page designation keys of confirmation copy page designation field 103 (for example, all pages and page designation for 1 page), position designation keys of position designation field 102 for designating the job information position (for example, center, upper-left, and lower-left), and job sheet size keys of job sheet size designation field 104 (for example, A3 wide, B4 wide, A4 wide, or the like) on the displayed confirmation-output mode setting screen, and control unit C stores the information in RAM M1 (Step S102). In this case, if a job sheet size has been already received as job information, the information can be set automatically and the operator need not select or specify it.

The other positions such as right-center and left-center and the like can be specified other than the above. Further, any position using X and Y coordinates can be specified. It is also possible to point out a position in a job information area displayed on the screen with a touch pen or the like.

Additionally, the job sheet size designation field can contain standard size keys (A4 for example), which are not illustrated, and non-standard size numeral keys (size designation) for designation of the information.

When receiving a starting command from operation panel 10, control unit C starts automatic document feeder 2 and image reading unit 3 which is a job information acquiring unit to acquire job image information, causes automatic document feeder 2 to feed document sheets one by one from a bundle of document sheets on automatic document feeder 2, causes image reading unit 3 to read each document sheet, and thus acquires job image information (Step S103).

It is also possible to acquire job information and job image information via an external server or the like, which is connected to the Internet by Internet communication unit C1 or another external server or the like, which is connected to a LAN by communication unit C2.

Then, control unit C assigns a page number to each of one or plural pieces of job-related job image information, while relating the job-related job image information to job information and stores it in RAM M1 (Step 5104).

Control unit C reads job sheet size information from RAM M1 and determines a sheet size of a trimmed sheet, which is one step smaller than a sheet size determined by the job sheet size information as a sheet size for confirmation output (for example, A4 size) according to the job sheet size information (for example A4 wide) (Step S105).

FIG. 5 shows an example of sheet size correspondence table stored in ROM.

Regarding determination of a sheet size for confirmation output, a sheet size correspondence table as shown in FIG. 5, which includes sheet size information for confirmation output corresponding to job sheet size information is stored in ROM M1 in advance. At Step S105, sheet size information for confirmation output corresponding to the job sheet size information is read and determined.

Control unit C reads position designation information (e.g. center) from RAM M1 at Step S102 and determines which area (e.g. center) of the job image information which was read at Step S103 is printed on a confirmation-output sheet which was determined at Step S105 (Step S106).

Control unit C edits job image information related to a job of a specified page (e.g. Page 1) which was read at Step S102 according to specified position information (e.g. center) and sheet size information (e.g. A4) determined at Step S105 and gets confirmation-output image information (Step S107).

Control unit C sends the edited confirmation-output image information to laser writing system 33, cause the system to form a latent image of the edited job-related image information on the surface of photosensitive drum 31, and causes developing unit 34 to make the image visible with toner on the photoreceptor drum (Step 108).

Meanwhile, automatic sheet feeder D selects a sheet feed tray, which contains sheets of a size for confirmation-output which was determined at Step S103 (e.g. A4) from among the trays D1 to D3, takes up sheets the number of which corresponds to the designation page information (e.g. 1 sheet for Page 1), and sends the sheets to photosensitive drum 31 from the sheet trays (Step S109).

In this case, allocation of sheet sizes to sheet feed trays D1 to D3 is registered in advance for selection and pick-up of sheets from a selected tray of the specified size.

Control unit C causes transferring electrode 35 to transfer the confirmation-output image to the supplied confirmation-output sheet and fixing unit 39 to fix the transferred image to the sheet by heating and pressing (Step S110).

Control unit C causes ejection rollers 53 to deliver the fixed sheet to a tray (e.g. sheet stacking tray 54 as the first tray) which was set by the tray selection key (e.g. first tray or second tray) in the confirmation print discharge tray field 105 on the confirmation-output mode setting screen (FIG. 4) (Step S111).

Here, control unit C can eject confirmation-output sheets preferentially to a sheet stacking tray the stacking surface of which can be observed.

Sheet stacking tray 54 is equipped with a sensor (not shown in the figure) to detect sheets placed on tray 54. By a detection output sent from the sensor, the control unit controls so that the top surface of the stacked sheets delivered by ejection rollers 53 may come to a position at which sheets can be ejected to the tray 54 properly without causing a sheet jam.

It is possible to discharge and stack sheets separately for normal jobs which require no confirmation output and for jobs which require confirmation output.

This can be accomplished by providing a change-over gate (not shown in the figure) to change sheet delivery paths between sheet stacking tray 54 and another sheet stacking tray 55 in the upstream side near the paper delivery slots of the image forming apparatus and changing the sheet delivery paths, for example, from the sheet stacking tray 54 position to the sheet stacking tray 55 position at a predetermined timing. Further, it is also possible to provide a driving unit (not shown in the figure) to move the sheet stacking trays 54 and another sheet stacking 55 so as to position, for example, tray 54 just at the paper delivery slot of the image forming apparatus during delivery in the normal print mode which requires no confirmation output and for example, and to position tray 55 just at the paper delivery slot of the image forming apparatus during delivery in the other job which requires confirmation output.

Further, job image information can include register mark information in advance (at the data entry timing). In this case, the position designating unit can be so designed to automatically detect the register marks in job image information and acquire position information. This can free the operator from manually setting position.

If the operator wants to check the confirmation-output image which has been outputted and correct the image positions, positional modification can be enabled on sheets. Below will be explained an example of manual positional operation in the case where the width of a stitching margin of sheet is corrected.

FIG. 6 shows an operation flow diagram of the application copy mode.

FIG. 7 shows an example of application mode basic screen for designating application copy modes.

Figure 8:
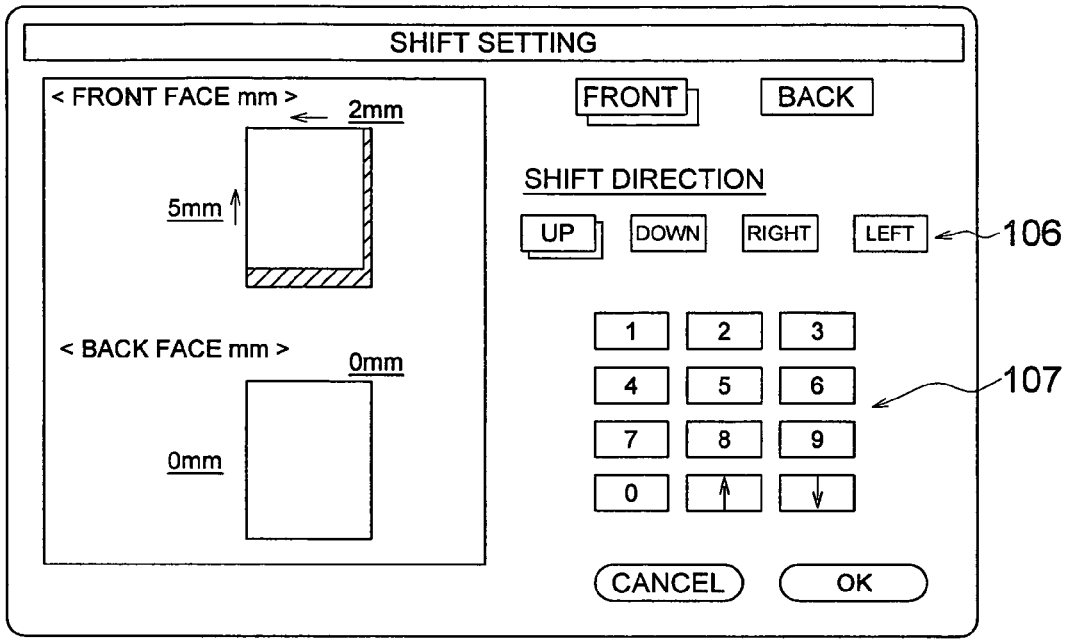
FIG. 8 shows an example of shift-setting screen for designating the amount of correction of an image position.

FIG. 8 shows an example of shift-setting screen for designating the amount of correction of an image position.

Figure 9:
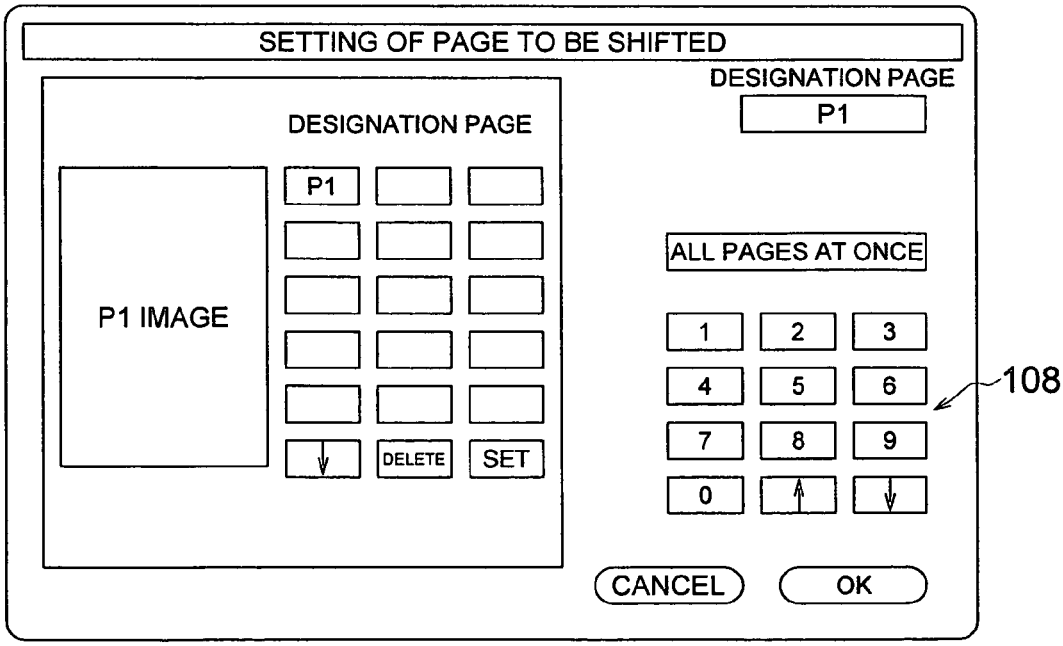
FIG. 9 shows an example of shift-page setting screen for designating a page to be shifted.

FIG. 9 shows an example of shift-page setting screen for designating a page to be shifted.

A method of correcting image positions will be explained below in reference to FIG. 2 and FIG. 6 to FIG. 9.

When an application mode execution command is entered from operation panel 10, control unit C reads information of the application-mode designation screen previously stored in ROM M2 and displays the application mode basic screen (FIG. 7) on display unit 101 (Step S201).

When "SHIFT" (enclosed in a dot-dash line) is selected on the application copy mode designation screen, control unit C reads shift designation information and shift setting screen information previously stored in ROM M2 and displays the shift setting screen (FIG. 8) on display unit 101 (Step S202).

When the operator presses a shift direction key 106 designating the shift direction and enters a shift quantity (e.g. 5 mm) by numeric keys 107 on the shift setting screen, control unit C reads the shift direction and the amount (e.g. 5 mm upward) and stores it in RAM M1 (Step S203).

Next, control unit C reads the information of the shift page setting screen previously stored in ROM M2 and displays the shift page setting screen (FIG. 9) on display unit 101. (Step S204).

When the operator specifies a page to be shifted (e.g., Page 1) by numeric keys 108 on the shift page setting screen, control unit C reads the entered page information and stores it in RAM M1 (Step S205).

The page number which is specified here or an image of the specified page can be displayed.

Control unit C reads shift-amount information and shift-page information from RAM M1 and edits the data again so that job image information of the page may be moved according to the shift-amount information (Step S206).

In the similar manner to Step S109 to Step S111, control unit C re-edits job image information and prints it out (Step S207).

This invention can provide an image forming apparatus which can print out high quality job images whose positions are corrected properly by correcting image positions after test printing for confirmation output.

Further, it is more preferable to display thumbnail pictures of pages of job image information specified at Step S102 and Step S205.

Control unit C can create the thumbnail pictures by reading job image information of specified pages among job image information which was stored in RAM M1 at Step S103, shrinking-them down to a preset size (e.g., ¼ to 1/10), and editing the shrunk job image information to display the shrunk images in a matrix on the screen.

The above page control is implemented using page numbers added to each piece of job image information at Step S104.

Below will be explained the configuration of an image forming apparatus which is a second embodiment of this invention and a controlling method of manual input of a confirmation-output sheet size.

The second embodiment is basically the same as the first embodiment except for manual input of confirmation-output sheet sizes. Therefore, only the differences in the block diagram and the flow diagram will be explained.

Figure 10:
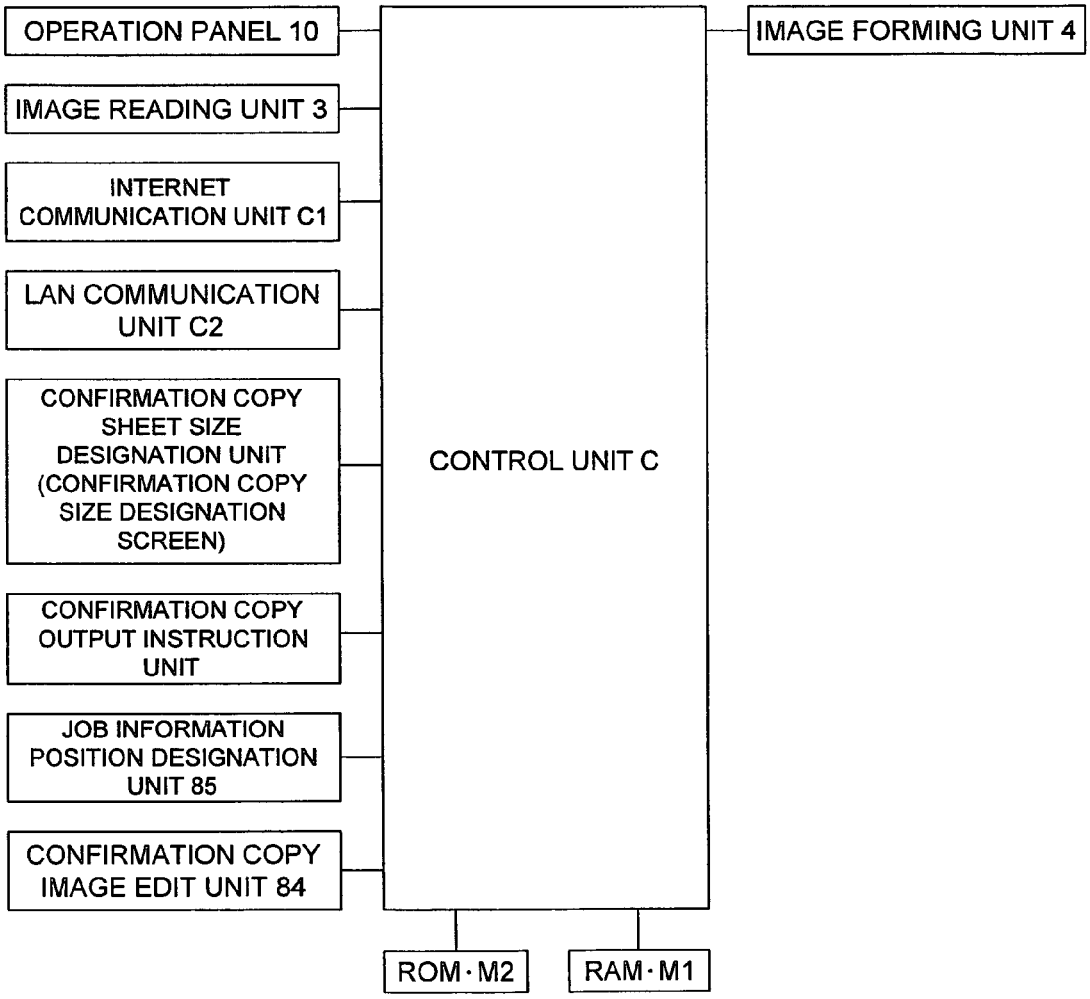
FIG. 10 shows a block diagram of a second embodiment of control of the image forming apparatus.

FIG. 10 shows a block diagram of a second embodiment of controlling of the image forming apparatus.

Referring to the block diagram (FIG. 10), image forming apparatus 1 has following units. An operation panel 10 is a confirmation-output sheet size input unit capable of entering a designation of a sheet size smaller than a job sheet size.

A job-information-position designation unit 85 specifies out-put area of job image information acquired by Internet communication unit Cl, LAN communication unit C2, or image reading unit 3 to be outputted on a sheet specified by the confirmation-output size designation screen. (the reference position of area to be confirmation-outputted from the job image information is positioned to any of four corners, any of centers of sides, the center, or an arbitrary point in a job image information area). And an editing unit 84 (confirmation copy image edit unit) edits to print job image information as confirmation-output image information on a position specified by the confirmation-output size designation screen in a sheet of a size which is specified by the confirmation-output size designation screen.

In this case, operation panel 10 displays the confirmation-output size designation screen (FIG. 12) on which a size of a confirmation-output sheet is inputted.

FIG. 13(*a*) shows that the reference position (basis) of the confirmation-output area in the job image information is placed on the upper end of the left long side of the job image information area. Similarly, FIG. 13(*b*) shows that the reference position is placed on the lower end of the left long side of the job image information area. FIG. 13(*c*) shows that the reference position is placed on the center of the left long side of the job image information area. FIG. 13(*d*) shows that the reference position is placed on the center of the upper short side of the job image information area. FIG. 13(*e*) shows that the reference position is placed on any position (x/y) in the job image information area. FIG. 13(*f*) shows reference positions which can be designated in the job image information area (not including arbitrary designated positions). In other words, nine basis points of FIG. 13(*f*) and arbitrary points of FIG. 13(*e*) can be designated.

An operational control flow of a second embodiment of the image forming apparatus will be explained below referring to FIGS. 10 to 12.

Figure 11:
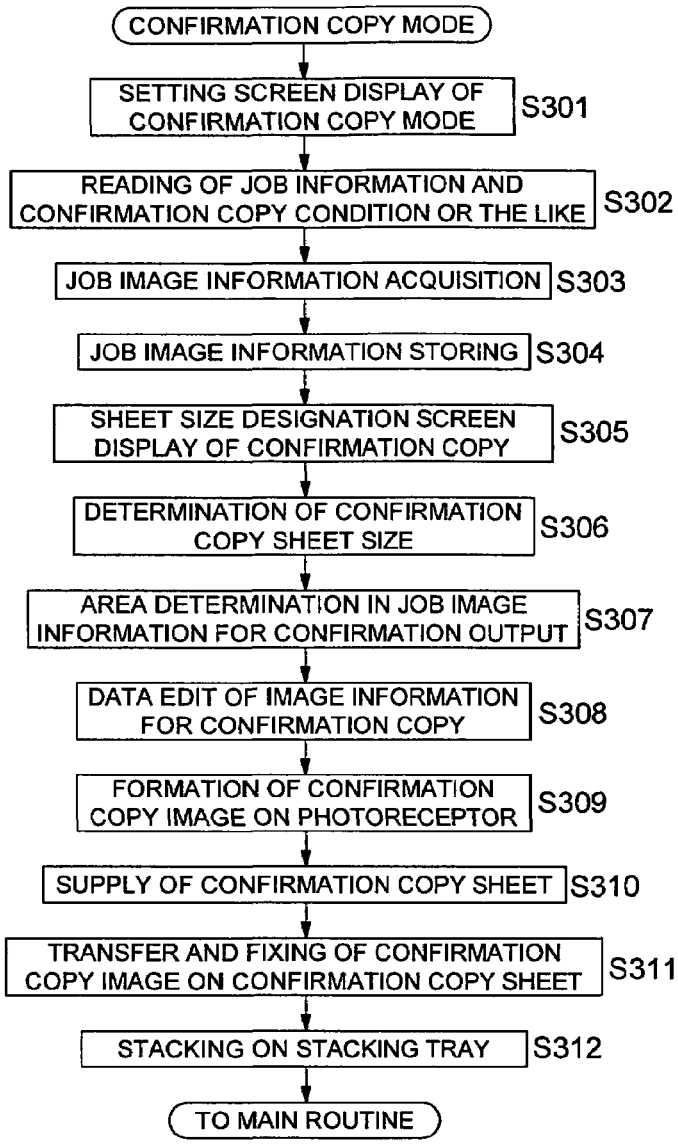
FIG. 11 shows a flow diagram of a second embodiment of control of the image forming apparatus.

FIG. 11 shows an operation flow diagram of a second control embodiment of the image forming apparatus.

Figure 12:
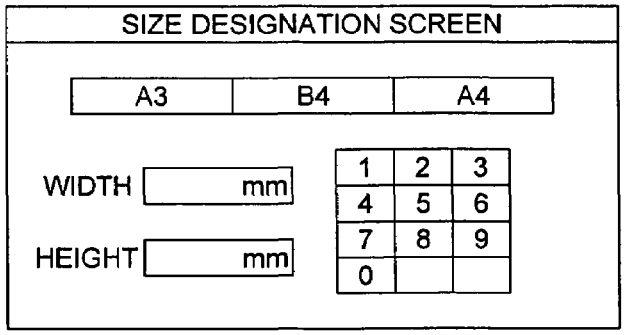
FIG. 12 shows an example of size designation screen for selecting and designating a sheet size for confirmation output.

FIG. 12 shows an example of confirmation-output size designation screen for selecting and specifying a sheet size for confirmation output.

Step S301 to Step S304 of steps to store job images are similar to Step S101 to Step S104 and the explanation will be omitted here.

ROM M2 stores information to display the confirmation-output size designation screen shown in FIG. 12 in advance. According to demands, control unit C reads the information from ROM M2 and displays it on display unit 101. The operator selects a size of a confirmation-output sheet for confirmation output. The selected sheet size information is inputted in control unit C.

Control unit C reads the size designation screen information from ROM M2 and displays the size designation screen (FIG. 12) on display unit 101 (Step S305).

The operator selects and specifies a predetermined sheet size (e.g. A4) on the size designation screen. Control unit C reads the size information and determines it as a confirmation-output sheet size (e.g. A4) (Step S306).

Here, a numeric key can be displayed on the screen to enable input of non-standard sheet size.

At Step S302, control unit C reads the page designating information (e.g. 1 page) and position designating information (e.g. center) from RAM M1.

Control unit C determines the print position in a page of the job, designated at Step S302, of job-related image information read at Step S303 to be printed in a confirmation-output sheet of a size specified at Step S306 (e.g. center) (Step S307).

Control unit C edits job-related image information of a page read at Step S302 according to the specified position information (e.g. center) and size information (e.g. A4) determined at Step S306 and gets information of the confirmation-output image (Step S308).

Step S309 to Step S312 of steps to form, transfer, fix a confirmation-output image and stack the sheet on a stacking tray are similar to Step S108 to Step S111 and the explanation will be omitted here.

Also in the second embodiment, it is possible to discharge and stack sheets separately for normal jobs which require no confirmation output and for jobs which require confirmation output as described in the first embodiment.

Further, as in the first embodiment, the job image information can include information about register marks in advance (at the entry timing). In this case, it is also possible to cause the position designating unit to automatically detect the register mark information in the job image information to get position information. This can free the operator from manually setting position information.

Figure 14:
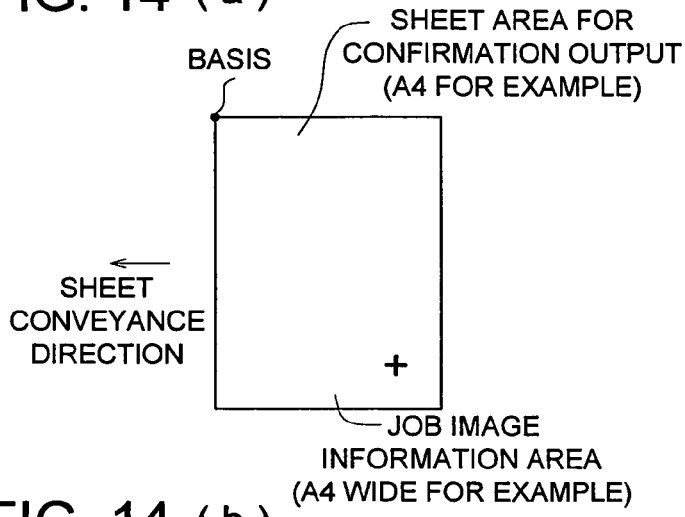
FIG. 14 shows explanatory drawings for a job image which includes the register marks.
Figure 14:
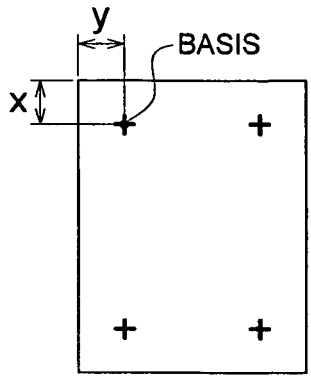
Figure 14:
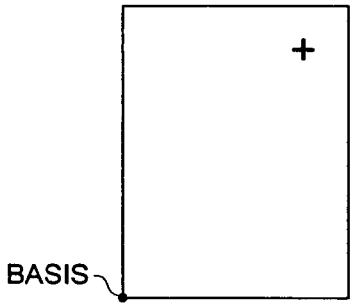
Figure 14:
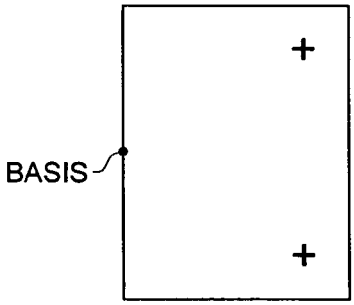
Figure 14:
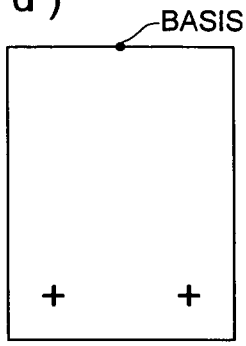

FIG. 14 shows an explanatory drawing for a job image information provided with register marks in advance.

FIG. 14(*a*) is job image information corresponding to FIG. 13(*a*) and an example having register mark. The register mark is indicated by a symbol "+". Cutting lines are made by connecting the intersections of symbols "+" or lines parallel to sheet sides through the marks "+".

Similarly, FIG. 14(*b*) to FIG. 14(*e*) correspond to FIG. 13(*b*) to FIG. 13(*e*) respectively and are job images including register marks.

The third embodiment of the image forming apparatus will be explained below.

In the third embodiment, it is configured that information of register marks is added to the job image information and the register mark information is used to set an area for confirmation output of job image information.

The following components can be provided to the configuration of the image forming apparatus: a register mark adding unit which adds information about register marks to job-related job image information which was acquired from the other image forming apparatus, Internet, or LAN, a confirmation-output sheet size determining unit which detects register mark positions and determines the sheet size of a confirmation-output sheet, an editing unit which edits the job information of an area enclosed by the added register marks so as to be printed on a confirmation-output sheet of a specified sheet size, and an image output unit which prints out images on the confirmation-output sheet according to the edited job information.

The operation of this embodiment is as follows:

Control unit C displays the acquired job-related job image information on display unit 101 (touch panel). When the operator touches anywhere in the job image on the screen, control unit C judges the touched position as a register mark position and stores the register mark position information in RAM M1. (Register mark adding unit)

Control unit C reads the register mark position information from RAM M1, calculates a diagonal distance between register marks from position information of register mark positioned diagonally, and determines a standard sheet size whose diagonal distance is greater than the result of the calculation as the confirmation-output sheet size. In this case, it is possible to calculate an area enclosed with register marks and determine a standard sheet size whose area is greater than the result of the calculation as the confirmation-output sheet size. (Confirmation-output sheet determining unit)

Control unit C reads job image information and register mark position information from RAM M1 and determines a confirmation-output area. Control unit C edits job image information according to the determined area and gets confirmation-output image information. (Editing unit)

Then, control unit C causes image forming unit 4 which is an image outputting unit to print out images on the confirmation-output sheet according to the obtained confirmation-output image information.

This invention can provide an image forming apparatus which can reduce unnecessary print-outs by adding register mark information to job image information which has been acquired by the job information acquiring unit, determining the size of a confirmation-output sheet corresponding to the position of the register marks, and printing job information which is contained in the area enclosed in the register marks on the confirmation-output sheet of the determined size so that it enables the operator to check a trimmed sheet and the print-out condition of the image before starting a job image formation.

Although in the third embodiment, it is structured to use additional register marks, job image information which has already included information of register marks can be used. In this case, the operator need not add register marks since the register marks already included are detected.

As already explained by the first and second embodiments, image positions on a sheet or on a selected page when a job contains multiple pages, can be corrected. Further, thumbnail images of specified pages can be displayed.

The present embodiments provide the following effects. Specifically, this invention can provide an image forming apparatus which can reduce unnecessary print-outs by printing a job image with register marks or the like, for example A4 wide-size image; on a confirmation-output sheet having a size similar to the sheet size after trimming, for example A4-size sheet, to enable the operator to check the trimmed sheet and the print-out condition of the image before starting a job image formation.

This invention can provide an image forming apparatus which enables the operator to check a trimmed sheet and the print-out condition of the image before starting a job image formation by test-printing an image on a sheet for confirmation output smaller than a sheet designated by job image information.

This invention can provide an image forming apparatus which can reduce the number of printed sheets for unnecessary pages and accomplish resource saving by test-printing only the selected pages of job image information for confirmation output.

This invention can provide an image forming apparatus which can print out high quality job images whose positions are corrected properly by correcting image positions after test printing for confirmation output.

This invention can provide an image forming apparatus which can reduce unnecessary print-outs by printing a job image with register marks or the like, for example A4 wide-size image, on a confirmation-output sheet having a size similar to the sheet size after trimming, for example A4-size sheet, to enable the operator to check the trimmed sheet and the print-out condition of the image before starting a job image formation.

What is claimed is:

1. An image forming apparatus comprising:

a job information acquiring unit for acquiring job information which includes sheet size information, relating to a job;

a job image data acquiring unit for acquiring job image data relating to the job;

a confirmation-output size determining unit for determining a size of a confirmation-output sheet according to the job information;

a job image area determining unit for determining an output area of the job image data, the output area being printed out on the confirmation-output sheet whose size is determined by the confirmation-output size determining unit;

an editing unit for editing the job image data as confirmation-output image data based on the output area determined by the job image area determining unit and the size of the confirmation-output sheet determined by the confirmation-output size determining unit; and an image forming unit for forming an image of the confirmation-output image data edited by the editing unit on the confirmation-output sheet.

2. The image forming apparatus of claim 1, wherein the confirmation-output size determining unit determines a sheet size which is smaller than a sheet size of the sheet size information as the size of the confirmation output sheet.

3. The image forming apparatus of claim 1, wherein the confirmation-output size determining unit determines that, when the sheet size information indicates a standard wide size, a standard normal size of the size is a sheet size for confirmation output, when the sheet size information indicates a standard size, a largest standard size smaller than the standard size is the sheet size and when the sheet size information indicates a non-standard size, a largest standard size smaller than the non-standard size is the sheet size.

4. The image forming apparatus of claim 1, further comprising:

a confirmation-output page designating unit for designating a page in which an image is to be formed on the confirmation-output sheet, wherein the editing unit edits job image data of the page, designated by the confirmation-output page designating unit, in the job image data of one or a plurality of pages as the confirmation-output image data.

5. The image forming apparatus of claim 1, wherein the job image area determining unit determines a reference position of the output area to be at any of four corners, any of centers of sides, a center, or an arbitrary position of the job image data.

6. The image forming apparatus of claim 1, wherein the job image data includes an area of image data to be cut out.

7. The image forming apparatus of claim 1, wherein the job image data includes a register mark for a trimming process.

8. The image forming apparatus of claim 7, wherein the job image area determining unit determines an image data enclosed by the register mark in the job image data as the output area.

9. The image forming apparatus of claim 7, wherein the job image area determining unit determines the output area of the confirmation-output size in the job data based on the register mark.

10. The image forming apparatus of claim 1, further comprising:

a register mark adding unit for adding a register mark to the job image data.

11. The image forming apparatus of claim 10, wherein the job image area determining unit determines the output area of the confirmation-output size in the job image data based on the added register mark.

12. The image forming apparatus of claim 10, wherein the job image area determining unit determines an area of the job image data enclosed by the added register mark as the output area.

13. An image forming apparatus comprising:

a job information acquiring unit for acquiring job information which includes sheet size information, relating to a job;

a job image data acquiring unit for acquiring job image data including a register mark, relating to a job and;

a confirmation-output size determining unit for determining a size of a confirmation output sheet according to the job information;

an editing unit for editing the job image data as confirmation-output image data based on the register mark and a confirmation-output sheet size determined by the confirmation-output size determining unit; and an image forming unit for forming an image of the confirmation-output image data edited by the editing unit on a confirmation-output sheet.

14. The image forming apparatus of claim 13, wherein the editing unit edits an area enclosed by the register mark as the confirmation-output image data.

15. The image forming apparatus of claim 13, wherein the confirmation-output size determining unit determines a confirmation-output sheet size which is smaller than a sheet size of the sheet size information.

16. The image forming apparatus of claim 13, wherein the confirmation-output size determining unit determines that, when the sheet size information indicates a standard wide size, a standard normal size of the size is a sheet size for confirmation output, when the sheet size information indicates a standard size, a largest standard size smaller than the standard size is the sheet size and when the sheet size information indicates a non-standard size, a largest standard size smaller than the non-standard size is the sheet size.

17. The image forming apparatus of claim 13, further comprising:

a confirmation-output page designating unit for designating a page in which an image is to be formed on the confirmation-output sheet, wherein the editing unit edits job image data of the page, designated by the confirmation-output page designating unit, in the job image data of one or a plurality of pages as the confirmation-output image data.

18. A controlling method of an image forming apparatus, the controlling method comprising steps of:

acquiring job image data relating to a job;

acquiring job information which includes sheet size information, relating to the job;

inputting information of a confirmation-output sheet whose size is smaller than a sheet size of the sheet size information in the job information;

determining an output area of the job image data, the output area being printed out on the confirmation-output sheet;

editing the determined output area of the job image data as confirmation-output data; and forming an image of the edited confirmation-output data on the confirmation-output sheet.

19. The image forming apparatus of claim 1, wherein a size of the output area of the job image data is as same as the size of the confirmation output sheet.

20. The controlling method of claim 18, wherein a size of the output area of the job image data is as same as the size of the confirmation output sheet.

* * * * *